US011913745B2

(12) United States Patent
Philbin et al.

(10) Patent No.: US 11,913,745 B2
(45) Date of Patent: Feb. 27, 2024

(54) CHARGING HANDLE FOR SUB-CALIBER UPPER RECEIVER ACTIONS

(71) Applicant: Perfetto Performance, Inc., Glenview, IL (US)

(72) Inventors: Kevin Philbin, Glenview, IL (US); Scott Richard Gherardini, Jr., Hoffman Estates, IL (US)

(73) Assignee: PERFETTO PERFORMANCE, INC., Glenview, IL (US)

( * ) Notice: Subject to any disclaimer, the term of this patent is extended or adjusted under 35 U.S.C. 154(b) by 0 days.

(21) Appl. No.: 17/816,002

(22) Filed: Jul. 29, 2022

(65) Prior Publication Data

US 2023/0142958 A1 May 11, 2023

Related U.S. Application Data

(60) Provisional application No. 63/227,211, filed on Jul. 29, 2021.

(51) Int. Cl.
*F41A 3/72* (2006.01)

(52) U.S. Cl.
CPC ..... *F41A 3/72* (2013.01)

(58) Field of Classification Search
CPC ..... F41A 3/72
USPC ..... 89/1.4
See application file for complete search history.

(56) References Cited

U.S. PATENT DOCUMENTS 8,505,428 B2 * 8/2013 Overstreet ..... F41A 3/72 89/1.4

* cited by examiner

*Primary Examiner* — Reginald S Tillman, Jr.
(74) *Attorney, Agent, or Firm* — CHERSKOV FLAYNIK & GURDA, LLC

(57) ABSTRACT

The present disclosure provides charging handles compatible with hold-open bolt carriers for using low-cost (e.g., 22LR) ammunition in a standard AR-15 or M16 upper receiver, such as an upper receiver of a Sig Sauer MCX firearm.

7 Claims, 7 Drawing Sheets

FIG. 1
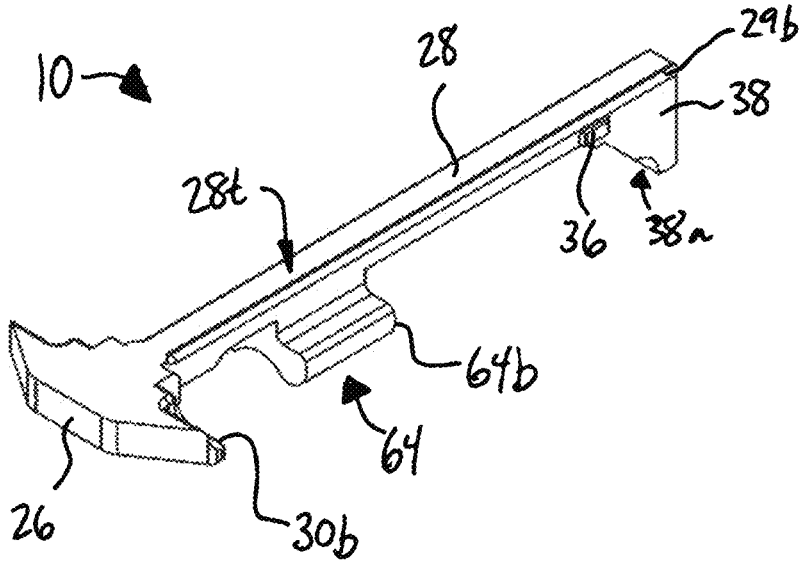
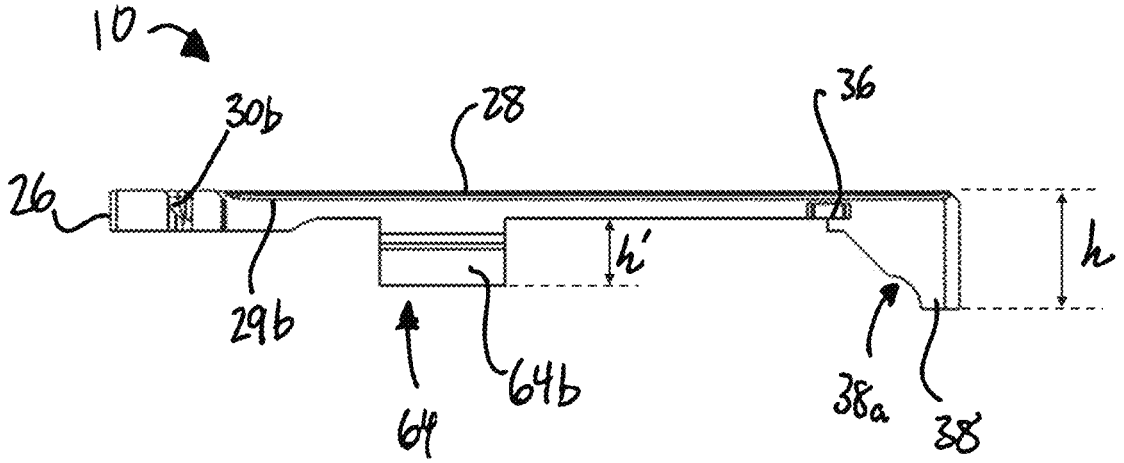
FIG. 2

FIG. 3
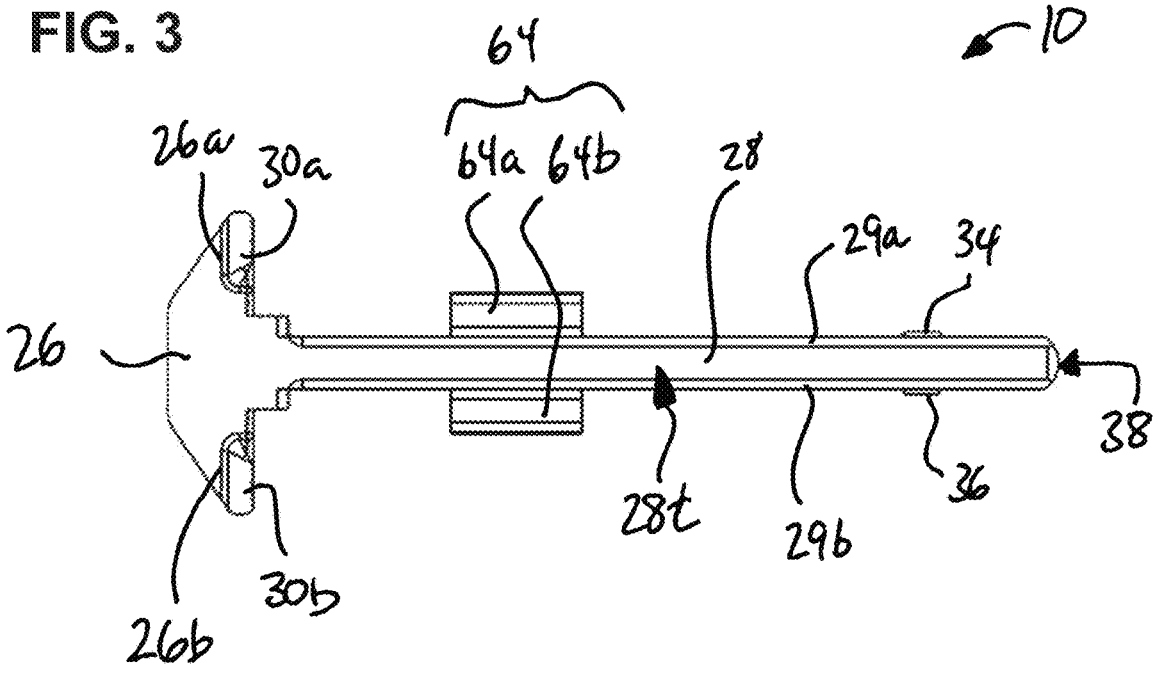
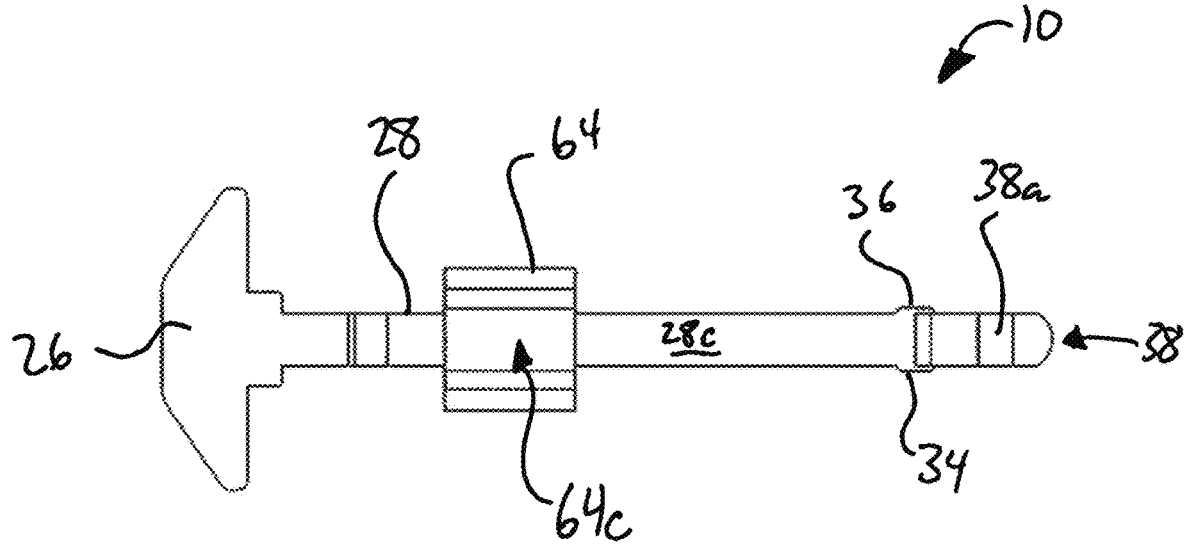
FIG. 4

FIG. 5
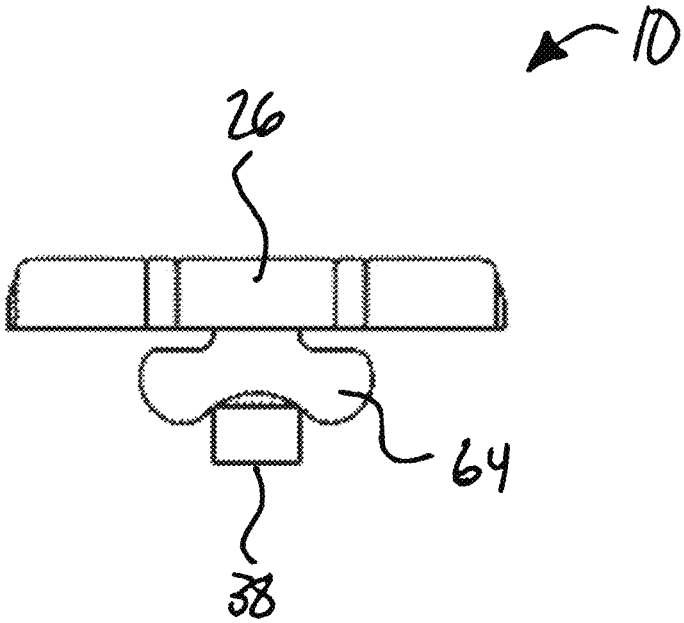
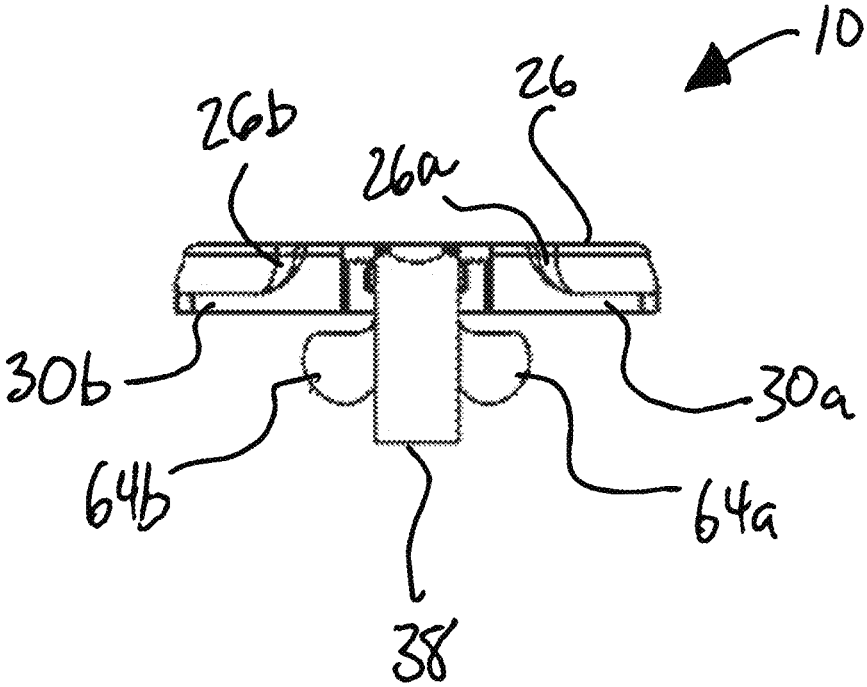
FIG. 6

CHARGING HANDLE FOR SUB-CALIBER UPPER RECEIVER ACTIONS

PRIORITY CLAIM

This application claims priority to U.S. Provisional Patent Application Ser. No. 63/227,211, filed on Jul. 29, 2021, the entire contents of which are incorporated herein by reference and relied upon.

CROSS-REFERENCE TO RELATED APPLICATIONS

This application refers to co-pending PCT Patent Application Serial No. PCT/US21/14953, filed Jan. 25, 2021, which claims priority to U.S. Provisional Patent Application Ser. No. 62/965,048, filed on Jan. 23, 2020; and U.S. patent application Ser. No. 17/684,387, filed Mar. 1, 2022, which claims priority to PCT/US21/14953, filed Jan. 25, 2021, which in turn claims priority to U.S. Provisional Patent Application Ser. No. 62/965,048, filed on Jan. 23, 2020, the contents of each of which are incorporated herein in their entireties and relied on.

BACKGROUND

The AR-15 and M16 firearm platforms are flexible, enabling reliable firing of many calibers of ammunition. However, ammunition native to the AR-15 and M16 platforms (e.g., 0.223 and 5.56 rounds) are relatively expensive, making regular training exercises with the AR-15 and M16 platforms costly. Sub-caliber conversion kits including a sub-caliber bolt and carrier and a sub-caliber ammunition magazine have recently been developed to address some of these economic concerns. For example, PCT Patent Application Serial No. PCT/US21/14953, filed Jan. 25, 2021, discloses a 22LR ammunition magazine, bolt, and carrier compatible with a wide range of AR-15 and M16 platforms manufactured to cycle larger ammunition rounds. However, standard AR-15 and M16 charging handles tend to suffer from compatibility issues with the sub-caliber bolts and carriers, and can cause spent cartridges to jam in the ejection port of the upper receiver.

Others have proposed complicated solutions to these problems, including telescoping charging handles, but such complicated designs also suffer from significant performance and compatibility issues. A need persists for reliable charging handles compatible with sub-caliber (e.g., 22LR) actions for AR-15 or M16 upper receivers, such as the Sig Sauer MCX rifle upper receiver.

SUMMARY

The present disclosure provides charging handles compatible with hold-open bolt carriers for using low-cost (e.g., 22LR) ammunition in a standard AR-15 or M16 upper receiver, such as an upper receiver of a Sig Sauer MCX firearm.

In some embodiments, the present disclosure provides a charging handle 10 for an upper receiver UR of a firearm, the charging handle comprising: an elongated stem 28; a bolt hook 38 disposed at a distal end of the elongated stem; a head 26 disposed at a proximal end of the elongated stem; at least one latch 30*a*,30*b* disposed in a seating aperture 26*a*,26*b* of the head; and a stabilizer 64 disposed on at least a portion of the elongated stem.

In other embodiments, the present disclosure provides a charging handle 10 for an upper receiver UR of a Sig Sauer MCX firearm fitted with a sub-caliber bolt carrier group BCG, the charging handle comprising: an elongated stem 28; a bolt hook 38 disposed at a distal end of the elongated stem and including a concave portion 38*a* for contacting a portion of the bolt carrier group; a head 26 disposed at a proximal end of the elongated stem and including at least one seating aperture 26*a*,26*b*; at least one latch 30*a*,30*b* disposed in the at least one seating aperture 26*a*,26*b*; and a stabilizer 64 extending from a bottom surface 28*c* of the elongated stem.

BRIEF DESCRIPTION OF THE DRAWINGS

FIG. 1 shows a perspective view of a charging handle consistent with one embodiment of the present disclosure.

FIG. 2 shows a side view of the charging handle of FIG. 1.

FIG. 3 shows a top view of the charging handle of FIG. 1.

FIG. 4 shows a bottom view of the charging handle of FIG. 1.

FIG. 5 shows a proximal end view of the charging handle of FIG. 1.

FIG. 6 shows a distal end view of the charging handle of FIG. 1.

DETAILED DESCRIPTION

Figure 7:
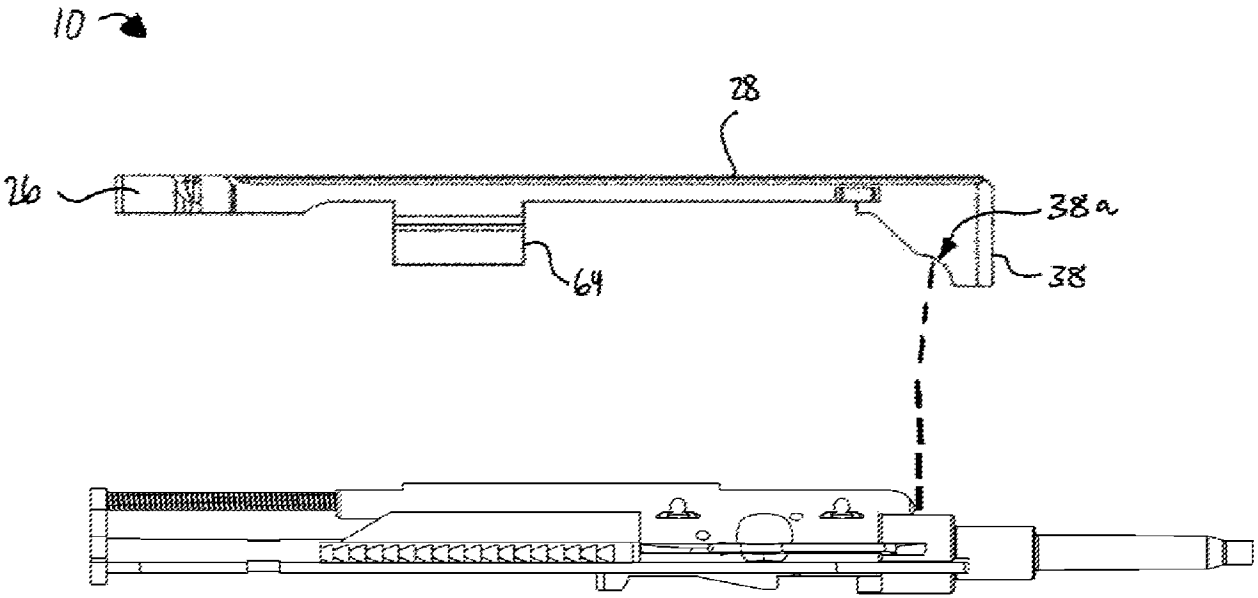
FIG. 7 shows a representative exploded view of the charging handle of FIG. 1 aligned with a sub-caliber bolt and bolt carrier compatible with a Sig Sauer MCX rifle.

Referring generally to FIGS. 1-7, the present disclosure provides charging handles 10 compatible with hold-open bolt carriers for using low-cost (e.g., 22LR) ammunition in a standard AR-15 or M16 upper receiver, such as an upper receiver of a Sig Sauer MCX firearm. The charging handles 10 consistent with the present disclosure generally include an elongated stem 28 including a bolt hook 38 disposed at its distal end, a head 26 disposed at its proximal end, and a stabilizer 64 configured to slidably mate with spring channels SC1,SC2 of an upper receiver UR, such as a Sig Sauer MCX upper receiver.

The elongated stem 28 is generally sized and shaped to fit over and distally forward of a bolt carrier group BCG within an upper receiver UR of a firearm. The bolt reciprocates forward and backward within the chamber BAC of the upper receiver UR as ammunition rounds (not shown) are cycled through the firearm. The elongated stem 28 is configured to not interfere with the reciprocating action of the bolt B {"B" is nowhere in the drawings} during normal operation.

The bolt hook 38 is disposed at the distal end of the elongated stem 28, and is sized and shaped to contact a portion of the bolt carrier group BCG as the charging handle 10 is withdrawn proximally from the upper receiver UR. The bolt hook 38 has a height h sufficient to contact an upper surface of the bolt carrier group BCG without interfering with the reciprocating action of the bolt B during normal operation. In some embodiments, the height h is about 3 cm to about 10 cm, for example about 3 cm, about 3.5 cm, about 4 cm, about 4.5 cm, about 5 cm, about 5.5 cm, about 6 cm, about 6.5 cm, about 7 cm, about 7.5 cm, about 8 cm, about 8.5 cm, about 9 cm, about 9.5 cm, or about 10 cm.

In some embodiments, the bolt hook 38 includes a concave contour 38*a* on its proximal face. When present, the concave contour 38*a* improves purchase of the bolt carrier group BCG with the bolt hook 38.

In some embodiments, the bolt hook 38 does not include a channel. For example and without limitation, conventional charging handles typically include a channel through which a gas tube feeds to provide reciprocating power to the bolt B from the gas vent assembly GVA. Alternatively, conventional charging handles specifically designed for the Sig Sauer MCX rifle system do not typically include a channel for accommodating a gas tube because the Sig Sauer MCX recoil system's gas vent assembly GVA directs gas to a piston P that forces an op rod OR associated with the bolt carrier group BCG proximal; the op rod OR includes a bolt hook catch BHC located proximal to the intersection of the piston P and the op rod's piston junction PJ.

The head 26 is disposed at the proximal end of the elongated stem 28 and is configured to enable the user to cause release and proximal retraction and removal of the bolt carrier group BCG from the chamber BAC. The head 26 includes a handle-shaped form. The head 26 may include a single latch 30*a* located on one side of the handle-shaped form, or alternatively may include one latch 30*a* on one side of the handle-shaped form and a second latch 30*b* located on the opposite side of the handle-shaped form. activation of the latch 30*a*,30*b* releases the head 26 (e.g., retracts a catch, not shown) to enable the charging handle 10 to be withdrawn rearward from the upper receiver UR. The one or more latches 30*a*,30*b* may be disposed within one or more seating apertures 26*a*,26*b* of the head 26.

The stabilizer 64 is configured to stabilize the charging handle 10 within the upper receiver UR. Generally, the stabilizer 64 is sized and shaped to fit within one or more channels of the upper receiver UR. In some embodiments, the one or more channels are spring channels SC1,SC2 configured to accommodate one or more recoil springs S1,S2 of the recoil system RS, for example when the rifle is outfitted with a standard caliber bolt carrier group BCG. In the specific embodiment shown representatively in FIGS. 1-7, for example, the stabilizer includes two lobes 64*a*,64*b* extending laterally from the elongated stem 28. Each lobe 64*a*,64*b* is sized and shaped to slide into and out of a spring channel SC1,SC2 of the upper receiver UR of a Sig Sauer MCX rifle. The stabilizer 64 may in some embodiments extend below the bottom surface 28*c* of the elongated stem 28.

In some embodiments, one or more wing projections 34,36 are disposed on the elongated stem 28 and are configured to slide within lateral channels or along guides (not shown) of the upper receiver UR. Generally, the wing projections 34,36 prevent the distal end of the charging handle 10 from dropping too low into the upper receiver UR.

In some embodiments, the top surface 28*t* of the elongated stem 28 includes one or more chamfers 29*a*,29*b*. The chamfers 29*a*,29*b*, when present, may improve slidability of the charging handle 10 as it is inserted and/or withdrawn from the upper receiver UR.

Generally, charging handles 10 consistent with the present disclosure improve operability of rifles equipped with sub-caliber bolt carrier groups BCG. Typically, an AR-15 rifle cycles 5.56 caliber rounds or .223 caliber rounds. In some embodiments, the charging handle 10 consistent with the present disclosure operates with a bolt carrier group BCG configured to cycle ammunition rounds other than a 5.56 caliber round or a .223 caliber round in an AR-15 rifle. In some embodiments, the sub-caliber bolt and carrier is configured to operate within an upper receiver of an AR-15 rifle with a bolt carrier group configured to cycle .22 caliber ammunition rounds, such as 22LR ammunition rounds.

An M16 rifle typically cycles 5.56 caliber rounds. In some embodiments, the charging handle 10 consistent with the present disclosure operates with a bolt carrier group BCG configured to cycle ammunition rounds other than a 5.56 caliber round in an M16 rifle. In some embodiments, the sub-caliber bolt and carrier is configured to operate within an upper receiver of an M16 rifle with a bolt carrier group configured to cycle .22 caliber ammunition rounds, such as 22LR ammunition rounds.

Sig Sauer's MCX rifle typically cycles 5.56 caliber rounds, .308 caliber rounds, 6.8 caliber rounds, or 0.300 AAC Blackout rounds. In some embodiments, the charging handle 10 consistent with the present disclosure operates with a bolt carrier group BCG configured to cycle ammunition rounds other than a 5.56 caliber round, a .308 caliber round, a 6.8 caliber round, or a 0.300 AAC Blackout round in a Sig Sauer MCX rifle. In some embodiments, the sub-caliber bolt and carrier is configured to operate within an upper receiver of a Sig Sauer MCX rifle with a bolt carrier group configured to cycle .22 caliber ammunition rounds, such as 22LR ammunition rounds.

Figure 8:
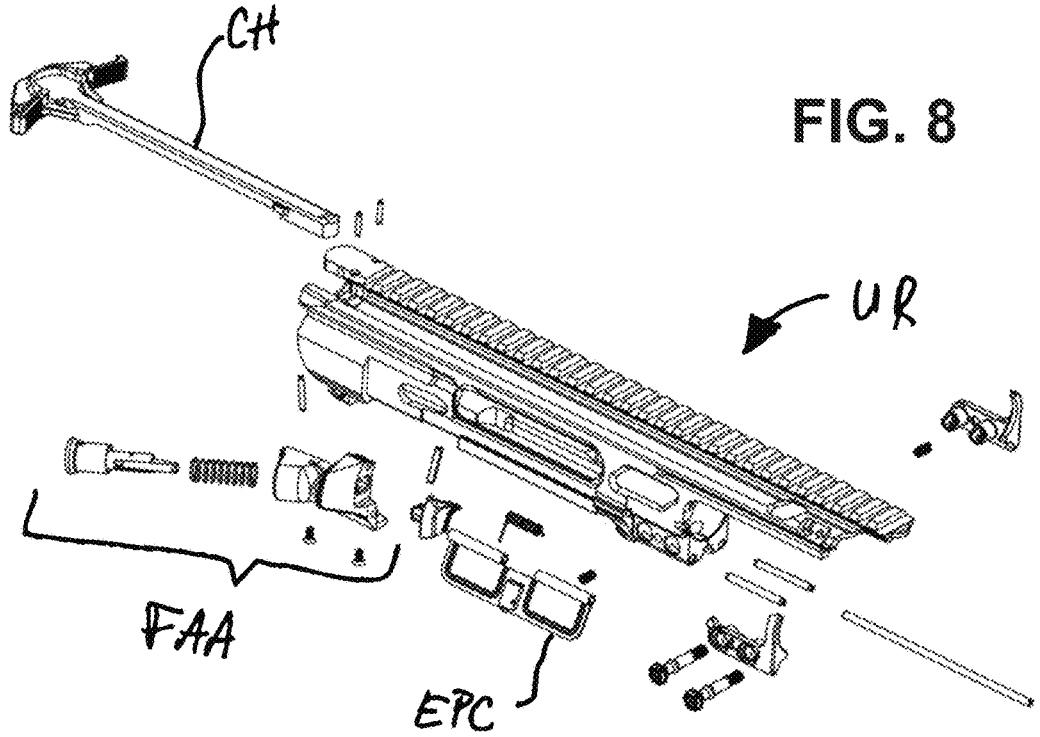
FIG. 8 shows a perspective exploded view of an upper receiver and standard charging handle of a Sig Sauer MCX firearm.
Figure 9:
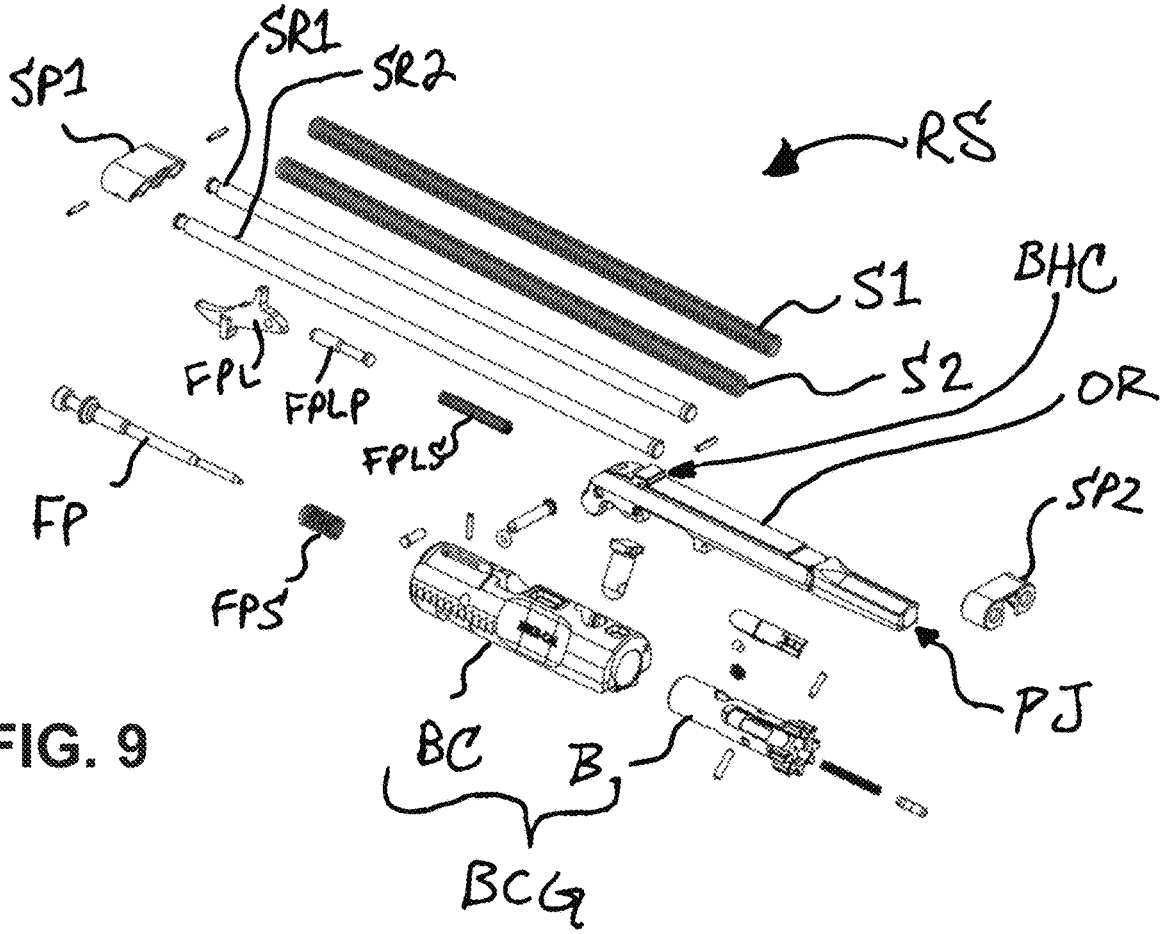
FIG. 9 shows a perspective exploded view of a bolt carrier group and recoil system of a Sig Sauer MCX firearm.
Figure 10:
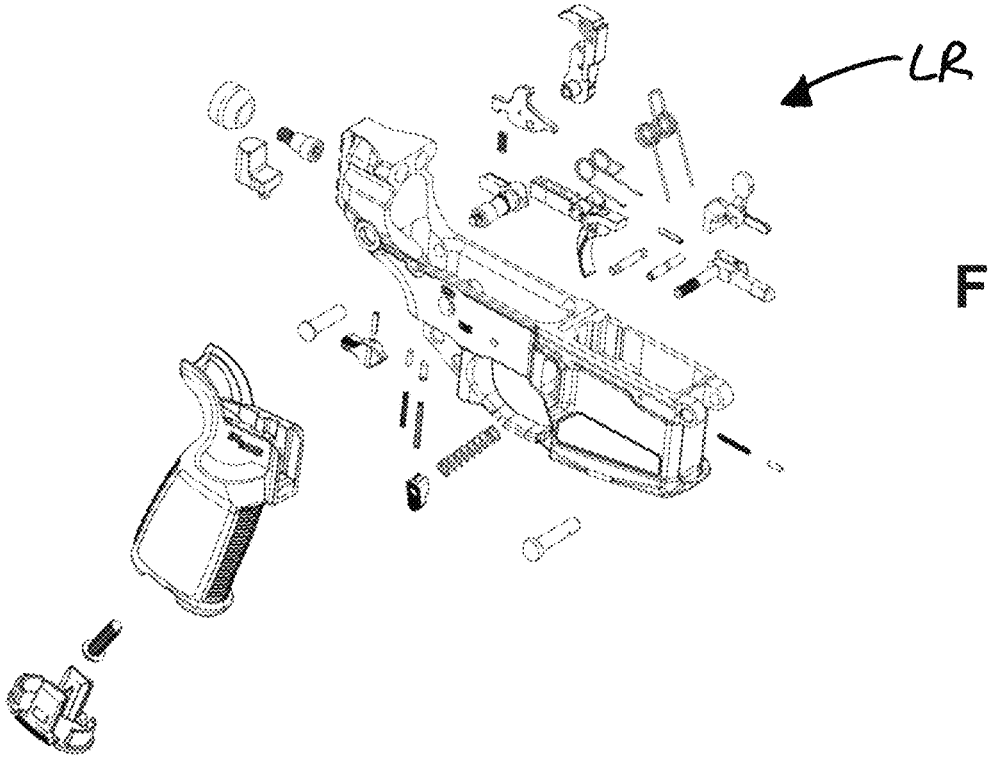
FIG. 10 shows a perspective exploded view of a lower receiver of a Sig Sauer MCX firearm.
Figure 11:
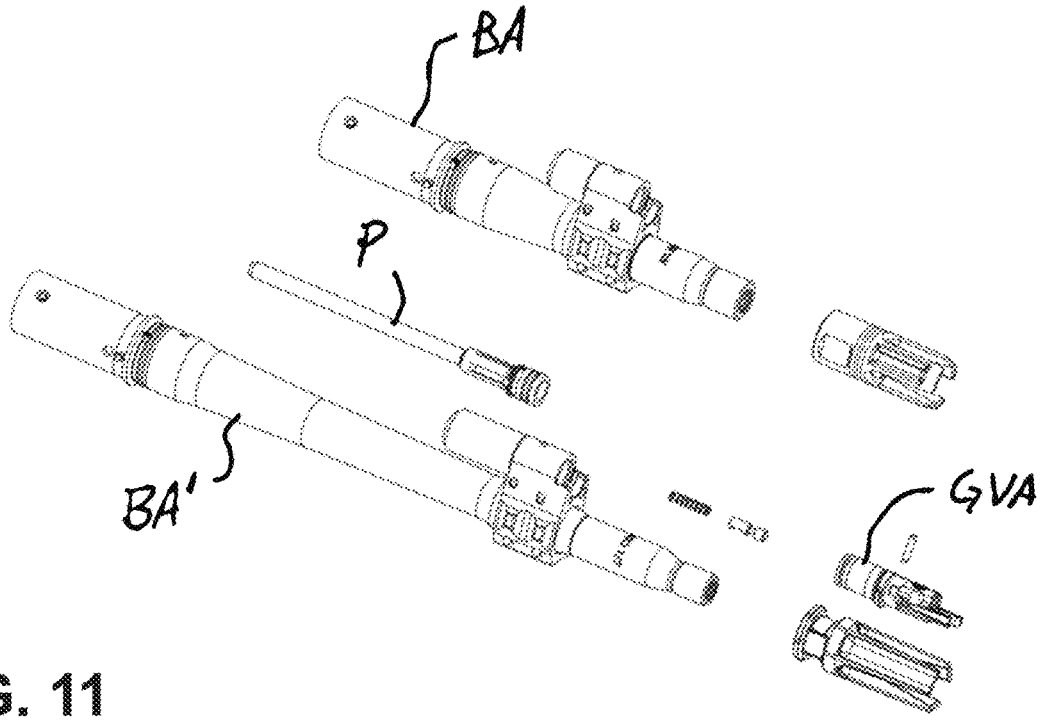
FIG. 11 shows a perspective exploded view of a barrel assembly and gas valve assembly of a Sig Sauer MCX firearm.

FIGS. 8-13 show components of the Sig Sauer MCX rifle platform. FIG. 8 illustrates the standard charging handle CH compatible with the MCX rifle platform's upper receiver UR that does not include a bolt hook 38 having a height h of about 3 cm to about 10 cm, or a stabilizer 64 configured to slidably mate with spring channels SC1,SC2 of the upper receiver UR. The MCX rifle's ejection port cover RPC and forward assist assembly FAA are also shown in FIG. 8. FIG. 9 shows the bolt carrier group BCG and recoil system RS of the MCX rifle. The recoil system RS includes two springs S1,S2 arranged side-by-side over respective first and second spring rods SR1,SR2 and between first and second spring plates SP1,SP2. the bolt carrier group BCG includes a bolt B, a bolt carrier BC, and a firing pin FP/firing pin spring FPS configured to cycle 5.56 or 0.300 Blackout caliber rounds. An op rod OR mates with the bolt carrier group BCG and includes a bolt hook catch BHC and piston joint PJ. A firing pin lock FPL, firing pin lock pin FPLP, and firing pin lock spring FPLS are also shown representatively in FIG. 9. The lower receiver LR of the Sig Sauer MCX rifle is shown in FIG. 10. The gas valve assembly GVA and piston P are shown representatively in FIG. 11, along with two barrel options BA,BA'. The proximal end of the piston P buts the piston joint PJ of the op rod OR to drive the bolt carrier group BCG rearward in response to gas directed to the piston via the gas valve assembly GVA with each round fired through the barrel BA/BA'.

Figure 12:
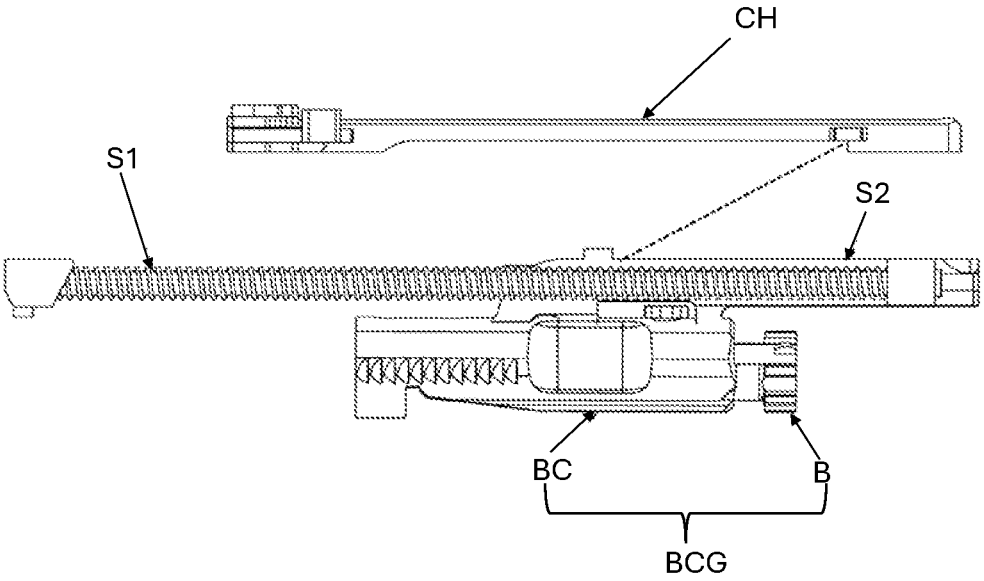
FIG. 12 shows a photograph of a Sig Sauer MCX bolt carrier croup, recoil system, and charging handle.
Figure 13:
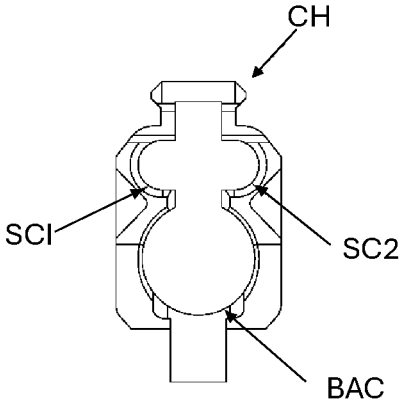
FIG. 13 shows a photograph of a proximal end view of a Sig Sauer MCX barrel/chamber.

In operation, the standard charging handle CH of the Sig Sauer MCX includes a catch that mates with the bolt hook catch of the op rod, as shown in FIG. 12. The spring channels S1,S2 and barrel chamber BAC of the Sig Sauer MCX rifle are shown in the photograph of FIG. 13.

What is claimed is:

1. A charging handle for an upper receiver of a firearm, the charging handle comprising:

an elongated stem;

a bolt hook disposed at a distal end of the elongated stem;

a head disposed at a proximal end of the elongated stem:

at least one latch disposed in a seating aperture of the head; and a stabilizer disposed on at least a portion of the elongated, wherein the stabilizer extends below a bottom surface of the elongated stem.

2. The charging handle of claim 1, wherein the stabilizer comprises a first lateral portion and a second lateral portion.

3. A charging handle for an upper receiver of a firearm, the charging handle comprising:

an elongated stem;

a bolt hook disposed at a distal end of the elongated stem;

a head disposed at a proximal end of the elongated stem;

at least one latch disposed in a seating aperture of the head; and a stabilizer disposed on at least a portion of the elongated stem;

wherein the stabilizer comprises a first lateral portion and a second lateral portion, and wherein the first lateral portion is configured to slidably mate with a first spring channel of an upper receiver, and wherein the second lateral portion is configured to mate with a second spring channel of the upper receiver.

4. The charging handle of claim 1 further comprising first and second wing projections each extending laterally from the first and second sides of the elongated stem.

5. The charging handle of claim 1, wherein the bolt hook does not include an aperture for a gas tube.

6. The charging handle of claim 1, wherein the bolt hook includes a concave surface for contacting a portion of a bolt carrier group.

7. The charging handle of claim 1 further comprising first and second chamfers disposed along the top surface of the elongated stem.

* * * * *